US008448291B2

(12) United States Patent
Conrad

(10) Patent No.: US 8,448,291 B2
(45) Date of Patent: May 28, 2013

(54) INLET FOR A VACUUM CLEANER

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 493 days.

(21) Appl. No.: 12/721,443

(22) Filed: Mar. 10, 2010

(65) Prior Publication Data

US 2010/0229327 A1 Sep. 16, 2010

(30) Foreign Application Priority Data

Mar. 11, 2009 (CA) ..... 2658017
Mar. 11, 2009 (CA) ..... 2658033
Mar. 11, 2009 (CA) ..... 2658038

(51) Int. Cl.
*A47L 5/24* (2006.01)

(52) U.S. Cl.
CPC ... *A47L 5/24* (2013.01); *Y10S 55/03* (2013.01)
USPC ..... 15/344; 15/327.2; 15/350; 55/DIG. 3

(58) Field of Classification Search
USPC ..... 15/344, 327.4, 327.7, 347, 327.2, 15/328, 329, 350, 352, 353; 55/328, 329, 55/337, DIG. 3
See application file for complete search history.

(56) References Cited

U.S. PATENT DOCUMENTS

| | | | | |
|---|---|---|---|---|
| 4,905,342 | A * | 3/1990 | Ataka | 15/327.7 |
| 7,370,387 | B2 | 5/2008 | Walker et al. | |
| 7,601,188 | B2 * | 10/2009 | Hwang et al. | 55/343 |
| 7,996,957 | B2 * | 8/2011 | Kah, Jr. | 15/353 |
| 2003/0106180 | A1 * | 6/2003 | Tsen | 15/321 |
| 2006/0156508 | A1 * | 7/2006 | Khalil | 15/353 |
| 2009/0106932 | A1 * | 4/2009 | Courtney | 15/347 |

FOREIGN PATENT DOCUMENTS

| | | | |
|---|---|---|---|
| WO | 2008/009890 | A1 | 1/2008 |
| WO | 2008009883 | A1 | 1/2008 |
| WO | 2008009888 | A1 | 1/2008 |

* cited by examiner

*Primary Examiner* — William Gilbert
(74) *Attorney, Agent, or Firm* — Philip C. Mendes da Costa; Bereskin & Parr LLP/S.E.N.C.R.L. s.r.l.

(57) ABSTRACT

A vacuum cleaner has a front, an upper portion and a lower portion. The vacuum cleaner comprises an air flow passage extending from a nozzle having a dirty air inlet to a clean air outlet. A cyclone unit comprises at least one cyclone having a cyclone air inlet positioned in the air flow passage. A suction motor is positioned in the air flow passage. In one aspect, the vacuum cleaner is a hand vacuum cleaner and the nozzle is positioned at a lower portion of the hand vacuum cleaner and preferably below the vacuum cleaner. In another aspect, the vacuum cleaner is a hand vacuum cleaner and the nozzle includes a lower open sided passage. In accordance with another aspect, the vacuum cleaner has an air treatment member that is positioned at least partially above the air inlet.

19 Claims, 8 Drawing Sheets

INLET FOR A VACUUM CLEANER

CROSS REFERENCES TO RELATED APPLICATIONS

This application claims priority from Canadian patent applications 2,658,017, 2,658,033, and 2,658,038, all filed on Mar. 11, 2009, and all of which are incorporated herein by reference in their entirety.

FIELD

The specification relates to surface cleaning apparatuses such as vacuum cleaners, and particularly, to cyclonic hand vacuum cleaners. More specifically, the specification relates to hand vacuum cleaners having a nozzle at a lower portion thereof, cleaning heads for cyclonic hand vacuum cleaners, and hand vacuum cleaners having an airflow chamber upstream from an inlet to an air treatment unit.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device. and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims.

According to one broad aspect, a cyclonic hand vacuum cleaner is provided wherein the inlet nozzle is provided at a lower portion of the hand vacuum cleaner and preferably adjacent the bottom of the hand vacuum cleaner and more preferably beneath the vacuum cleaner. An advantage of this design is that the hand vacuum cleaner may be placed on a floor and may be moved along the floor with the nozzle placed on the floor. Accordingly, for example, the hand vacuum cleaner may be provided with wheels and slid or rolled over a surface to be cleaned.

This design may be achieved by positioning the cyclone, or a first stage cyclone, with the air inlet at a lower portion thereof, preferably the bottom thereof. Accordingly, the dirty air may travel from the nozzle upwardly, and preferably generally vertically upwardly, to the cyclone chamber.

In accordance with this aspect, the hand vacuum cleaner may have a front, an upper portion, a lower portion, and an air flow passage extending from a nozzle having a dirty air inlet to a clean air outlet. A cyclone unit comprises at least one cyclone having a cyclone air inlet positioned in the air flow passage. A suction motor is positioned in the air flow passage. The nozzle may be fixedly positioned at the lower portion of the hand vacuum cleaner.

In some examples, the nozzle is positioned at the bottom of the hand vacuum. Further, in some examples, the nozzle is positioned beneath at least a portion of the cyclone unit.

In some examples, the nozzle extends generally horizontally.

In some examples, the nozzle may be a longitudinally extending enclosed conduit. In other examples, the nozzle may have an open lower surface and comprise an open sides airflow chamber. For example, the nozzle may have an upper nozzle wall that comprises at least a portion of the lower wall of the cyclone unit and an open side positioned adjacent the surface to be cleaned when the hand vacuum cleaner is in use.

In some examples, the nozzle further comprises a depending wall extending downwardly from the upper nozzle wall. The depending wall may be generally U-shaped.

In some examples, the cyclone inlet is in communication with an opening positioned in the upper nozzle wall. The opening may face a surface to be cleaned.

In some examples, the nozzle has an open lower end and extends to the front of the hand vacuum cleaner.

In some examples, the hand vacuum cleaner further comprises a plurality of wheels, the nozzle has a nozzle axis that extends generally horizontally when the wheels are in contact with a horizontal surface to be cleaned, and the nozzle has an open lower end.

In some examples, the motor is positioned rearward of the cyclone.

In some examples, the cyclone unit includes a dirt chamber, at least a portion of the dirt chamber is below at least a portion of the cyclone, and the nozzle is positioned below the dirt chamber.

In some examples, the cyclone unit includes a dirt chamber having at least portion extending around the cyclone.

In some examples, the hand vacuum cleaner further comprises a plurality of wheels, the cyclone unit comprises at least one cyclone and the cyclone has a cyclone axis that extends generally horizontally when the wheels are in contact with a horizontal surface to be cleaned.

In some examples, the cyclone has a cyclone width, and the nozzle has a nozzle width that is about the same as the cyclone width.

In some examples, the cyclone has a cyclone axis, the motor has a motor axis and the cyclone axis and the motor axis extend in the same direction.

According to another broad aspect, a hand vacuum cleaner is provided wherein the nozzle comprises an open sided airflow chamber. The nozzle comprises a channel or airflow chamber extending from a dirty air inlet to an enclosed passage leading to an air treatment unit. At least a portion, and preferably all, of the lower side of the channel is open. Accordingly, when the nozzle is placed on a surface to be cleaned (e.g., a floor), the floor effectively defines the lower side of the channel. The air travels through the channel, preferably underneath part or all of the air treatment unit to an enclosed passage leading to the air treatment passage.

In accordance with this aspect, the hand vacuum cleaner may comprise an airflow passage extending from a dirty air inlet to a clean air outlet with an air treatment unit and a suction motor positioned in the airflow passage. The air treatment unit has an air treatment unit air inlet. The hand vacuum cleaner may further comprise an airflow chamber having a closed upper end, at least one open sidewall, and an open lower end. The air treatment unit air inlet is spaced from the open sidewall and may be provided in the upper end. The airflow chamber defines a flow passage such that air travels from the at least one open sidewall under the hand vacuum cleaner to the air treatment unit air inlet.

In some examples, the airflow chamber further comprises a depending wall extending downwardly from the upper wall. The depending wall may be generally U-shaped.

In some examples, the hand vacuum cleaner further comprises a plurality of wheels. The wheels may have a lower end wherein the depending wall has a lower end that is spaced above the lower end of the wheels.

In some examples, the lower end of the depending wall is positioned above a hard surface when the wheels are placed on the hard surface.

In some examples, the airflow chamber extends to the front of the hand vacuum cleaner. The dirty air inlet may be positioned at the front of the hand vacuum cleaner. The airflow chamber may extend from the dirty air inlet rearwardly to the air treatment unit air inlet. The air treatment unit air inlet may be positioned forwardly of a rear depending wall.

In some examples, the hand vacuum cleaner further comprises a plurality of wheels and the airflow chamber has an airflow chamber axis that extends generally horizontally when the wheels are in contact with a surface to be cleaned.

In some examples, the air treatment unit air inlet faces a surface to be cleaned when the hand vacuum cleaner is positioned on a surface to be cleaned.

In some examples, the airflow chamber has an upper wall that comprises at least a portion of a lower wall of the hand vacuum cleaner, the airflow chamber has an open side positioned adjacent a surface to be cleaned when the hand vacuum cleaner is in use, and the air flow chamber has a height that extends between the lower wall of the hand vacuum cleaner and the lower end of the depending wall.

In some examples, the air treatment unit inlet is positioned in the upper wall. The air treatment unit may be positioned above the airflow chamber.

In some examples, the air treatment unit comprises at least one cyclone.

In some examples, the hand vacuum cleaner has a perimeter, a front end, a rear end and sides extending between the front end and the rear end. The at least one open side wall may be positioned at the perimeter, and the air treatment unit air inlet may have a width and may be positioned inwardly from the sides by at least the same distance as the width. Further, the air treatment unit air inlet may have a longitudinal length, and may be positioned rearwardly from the front end by at least the same distance as the longitudinal length.

In some examples, the air treatment unit air inlet has a width in a direction transverse to the longitudinal length and is positioned inwardly from the sides by at least the same distance as the width.

According to another broad aspect, a cleaning head for a surface cleaning apparatus is provided wherein the air flow channel to a cyclone inlet is upwardly and, preferably generally vertically upwardly. The airflow path may be relatively short. In addition, the airflow path may be relatively linear, other than a curve that may be provided to impart a tangential flow to the air stream. For example, dirty air may be drawn into an enclosed airflow conduit that extends without any 90° bends to a cyclone chamber, thereby reducing back-pressure. The reducing in back pressure permits the use of a smaller motor and/or a higher airflow speed. It will be appreciated that the channel may be curved to introduce the air tangentially into a cyclone. Alternately, or in addition, one or more members may be provided in the cyclone to cause the air to travel in a swirling pattern in the cyclone.

Accordingly, for example, the cleaning head may comprise an opening in a lower outer wall of the cleaning head, and a cyclone unit comprising at least one cyclone having a cyclone inlet fixed above the opening. The cyclone inlet is fixed such that, during operation of the cleaning head to clean a floor, the cyclone is positioned at all times above the opening. It will be appreciated that the cyclone unit, or part thereof, may be removably mounted to the cleaning head to permit the cyclone unit to be emptied.

In some examples, the cleaning head further comprises an airflow passage extending from a dirty air inlet to a clean air outlet. A portion of the airflow passage may extend from the opening to the dirty air outlet. The portion of the airflow passage surrounds the airflow as it travels through the passageway and the opening comprises the entrance to the passageway. Accordingly, the opening may comprise the entrance to an enclosed longitudinally extending conduit that extends to the entrance to a cyclone chamber.

In some examples, the cleaning head further comprises an airflow chamber upstream from the opening, and the airflow chamber has an open lower end.

In some examples, the lower outer wall comprises a closed upper end of the airflow chamber upstream.

In some examples, the airflow chamber comprises at least one open side wall and an open lower end and defines a flow passage such that air travels from the at least one open side wall under the cleaning head to the opening. In such an example, the open side wall comprises the dirty air inlet.

In some examples, the airflow chamber further comprises a depending wall extending downwardly from the closed upper end. The depending wall may be generally U-shaped. In other example, the depending wall maybe positioned only rearward of the opening. The depending wall may be continuous or discontinuous and may be rigid or moveable.

In some examples, the cleaning head further comprises a plurality of wheels. The wheels may have a lower end, and the depending wall may have a lower end that is spaced above the lower end of the wheels. The lower end of the depending wall may be positioned above a surface to be cleaned when the wheels are in contact with the surface to be cleaned.

In some examples, the airflow chamber extends to the front of the cleaning head.

In some examples, the opening is in communication with a cyclone inlet. A passage may extend upwardly from the opening to the cyclone inlet.

In some examples, a dirty air inlet is positioned at the front of the cleaning head. The airflow chamber may extend from the dirty air inlet rearwardly to the opening. The opening may be positioned forwardly of a rearwardly positioned depending wall.

In some examples, the cleaning head further comprises a plurality of wheels and the airflow chamber has an airflow chamber axis that extends generally horizontally when the wheels are in contact with a surface to be cleaned.

In some examples, the airflow chamber has an absence of a rotating agitator.

In some examples, the opening faces a surface to be cleaned when the cleaning head is positioned on a surface to be cleaned.

In some examples, the cleaning head has a perimeter, a front end, a rear end and sides extending between the front end and the rear end. At least one open sidewall defines a dirty air inlet and is positioned at the perimeter, and the opening has a width and is positioned inwardly from the sides by at least the same distance as the width. Further, the opening may have a longitudinal length and may be positioned rearwardly from the front end by at least the same distance as the longitudinal length. In some examples, the opening has a width in a direction transverse to the longitudinal length and is positioned inwardly from the sides by at least the same distance as the width.

In some examples, the cleaning head further comprising a suction motor.

In some examples, the cleaning head is part of a hand vacuum cleaner.

It will be appreciated that a hand vacuum cleaner may incorporate one or more of the features of each of these examples. Further, each aspect may be used singly in a surface cleaning apparatus. In other embodiments, two or all three aspects may be used in the same surface cleaning apparatus.

DRAWINGS

In the detailed description, reference will be made to the following drawings, in which.

DESCRIPTION OF VARIOUS EXAMPLES

Figure 1:
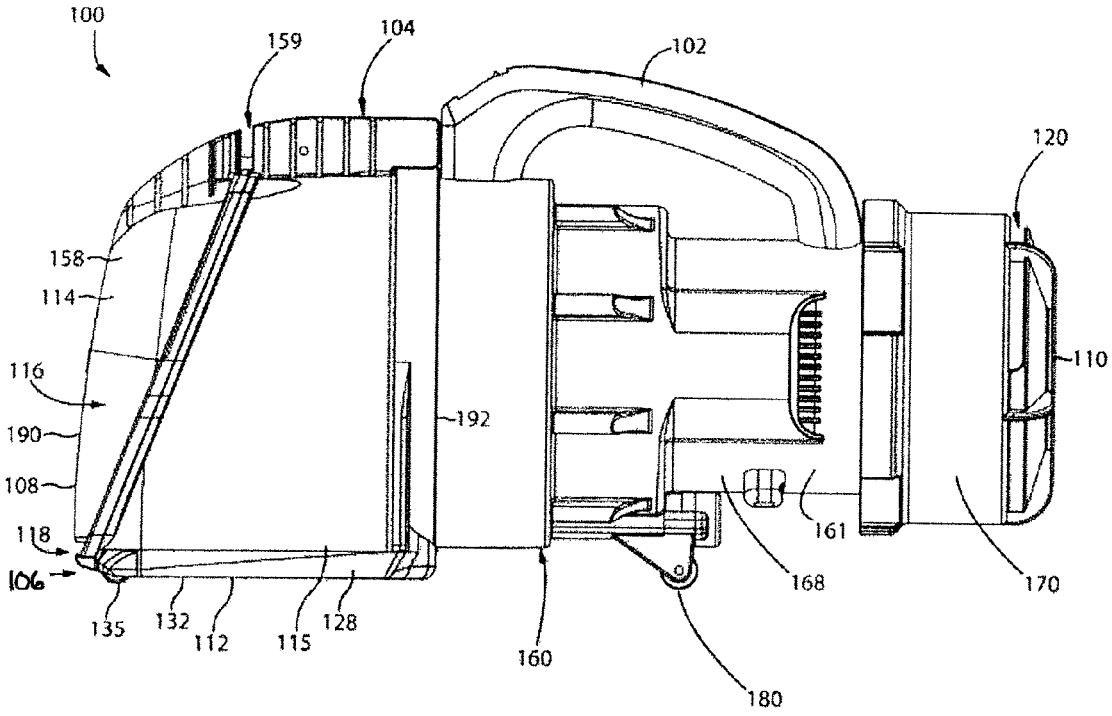
FIG. 1 is a side plan view of an example of a hand vacuum cleaner.

Various apparatuses or methods will be described below to provide an example of each claimed invention. No example described below limits any claimed invention. The claimed inventions are not limited to apparatuses or processes having all of the features of any one apparatus or process described below or to features common to multiple or all of the apparatuses described below.

The following description is of a hand vacuum cleaner. It will be appreciated that the cleaning head design may be incorporated into the surface cleaning head of another surface cleaning apparatus including the floor cleaning head of an upright vacuum cleaner, a canister vacuum cleaner, a stick vacuum cleaner, a carpet extractor or the like. The design is preferably used with a hand vacuum cleaner as it permits a hand vacuum cleaner having a compact footprint.

Referring to FIGS. 1 to 7, a first example of a vacuum cleaner 100 is shown. The vacuum cleaner 100 is a hand vacuum cleaner, and is movable along a surface to be cleaned by gripping and maneuvering handle 102. The vacuum cleaner includes an upper portion 104, a lower portion 106, a front 108, and a rear 110. In the example shown, handle 102 is provided at the upper portion 104. In alternate examples, handle 102 may be provided elsewhere on the vacuum cleaner 100, for example at the rear 110, and may be of any design. The vacuum cleaner 100 may be of various configurations (e.g., different positioning and orientation of the air treatment unit, the suction motor and differing air treatment units that may comprise one or more cyclones and optional filters), however the nozzle is preferably located at all times at a lower portion of the vacuum cleaner 100, and is positionable against a surface to be cleaned.

In the example shown, the vacuum cleaner 100 comprises a nozzle 112 and an air treatment unit 114, which together form a surface cleaning head 116 of the vacuum cleaner 100. In the example shown, the surface cleaning head 116 is preferably provided at the front 108 of the vacuum cleaner 100. The cleaning head 116 includes an outer wall 115 (which is also an outer wall 115 of the air treatment unit 114). The outer wall 115 includes a lower outer wall 119 (also referred to herein as a lower portion of the outer wall 115), which in the example shown is generally planar, and which faces a surface to be cleaned when the vacuum cleaner 100 is in use. The lower outer wall 119 forms a lower surface 157 of the air treatment unit 114.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Air treatment unit 114 is provided in the airflow passage, downstream of the dirty air inlet 118. In the example shown, the air treatment unit 114 comprises one cyclone 122, and one dirt chamber 124, and may accordingly be referred to as a cyclone unit. In alternate examples, the air treatment unit 114 may include more than one cyclonic stage, wherein each cyclonic stage comprises one or more cyclones and one or more dirt chambers. Accordingly, the cyclones may be arranged in parallel and/or in sequence. While it is preferred to utilize at least one cyclone, it will be appreciated that, in other embodiments, the air treatment unit may comprise a plurality of filters and/or other dirt separation means and may not include any cyclones.

Figure 6:
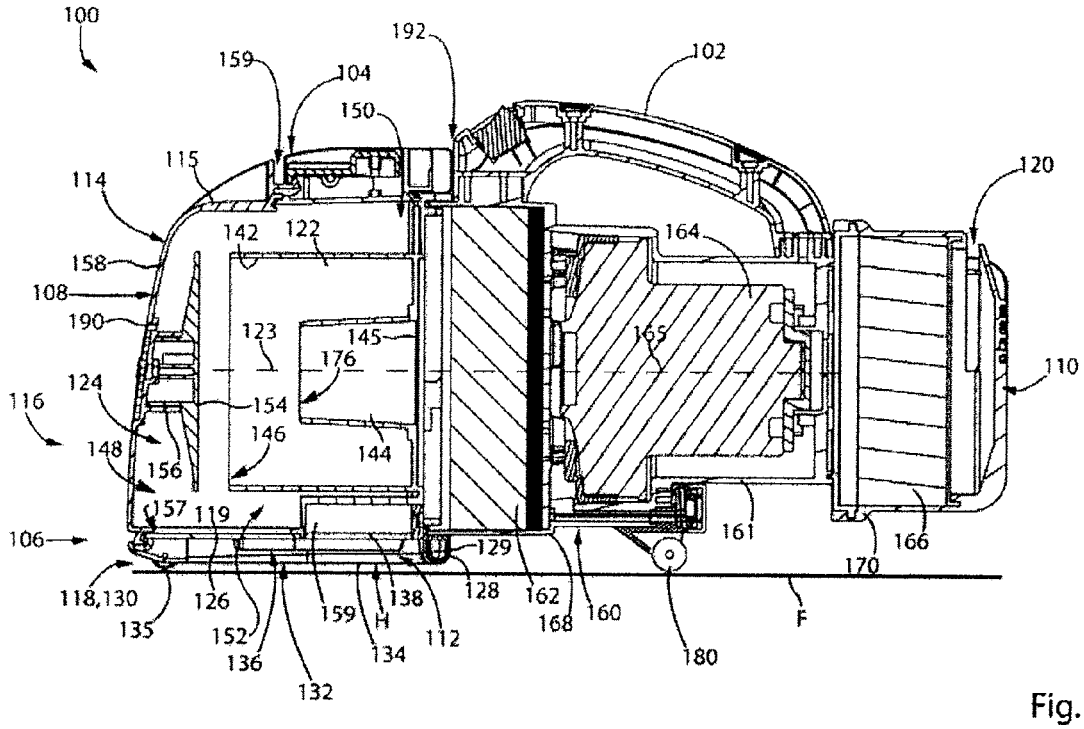
FIG. 6 is a cross section taken along line 6-6 in FIG. 2.

In accordance with a first aspect, the nozzle 112 is positioned at the lower portion 106 of a hand vacuum cleaner. Preferably, as exemplified, nozzle 112 is positioned at the bottom of the hand vacuum cleaner (below a lower surface of the hand vacuum cleaner), and more preferably beneath the air treatment unit 114. Accordingly, as exemplified, nozzle 112 may be on the lower surface 157 of the air treatment unit 114. In a particularly preferred design, the upper wall 126 of the nozzle may be the lower surface 157 of the air treatment unit 114. As shown in FIG. 6, the air treatment unit is a cyclone unit and dirt chamber 124 surrounds the lower portion of cyclone 122. Accordingly, the upper wall 126 of nozzle 112 may be part of the lower wall of the dirt chamber 124. It will be appreciated that if dirt chamber 124 does not extend around the lower portion of cyclone 122, then the upper wall 126 of nozzle 112 may be part of a lower wall of cyclone 122.

Preferably, as shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
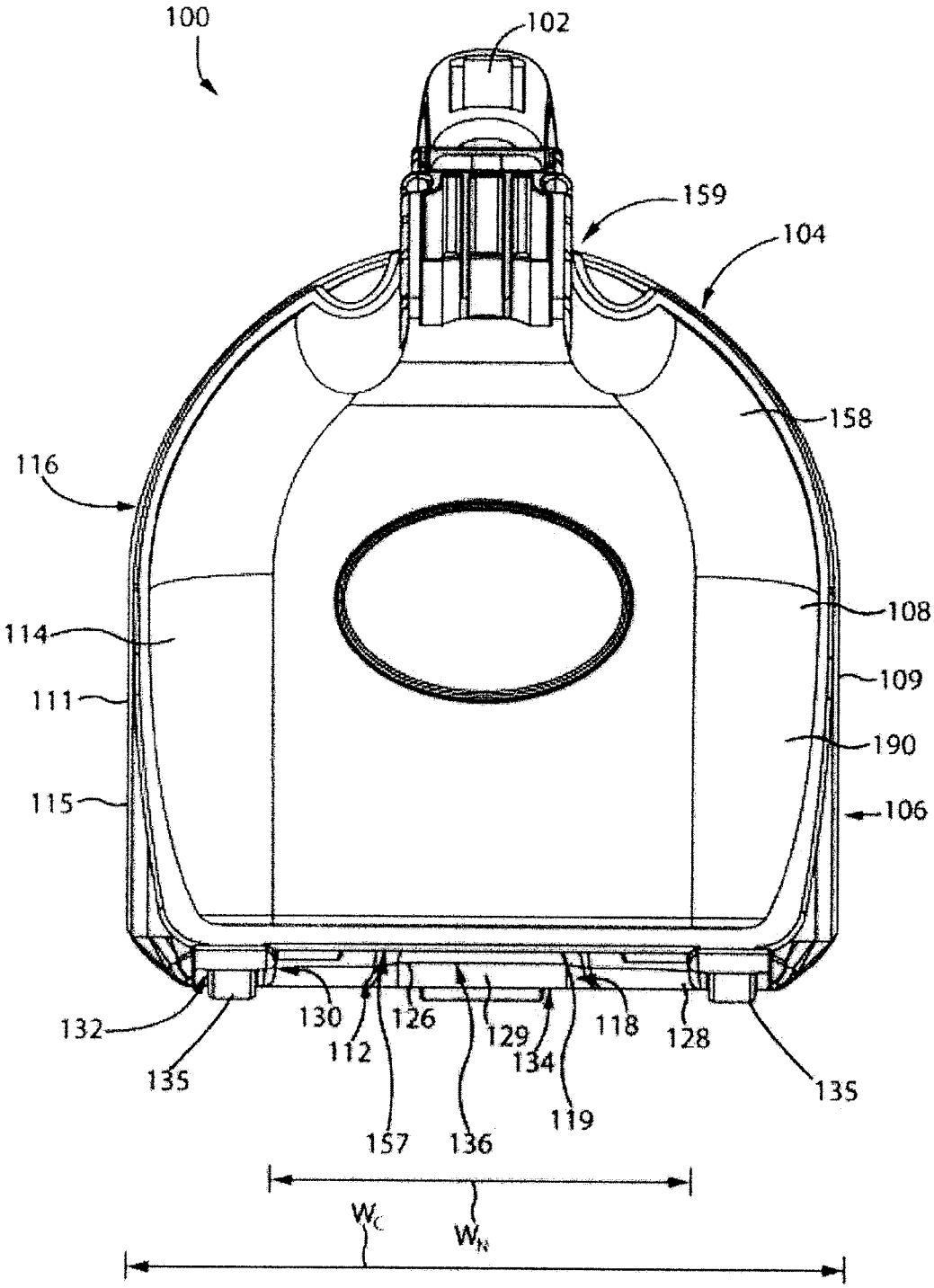
FIG. 3 is a front plan view of the hand vacuum cleaner of FIG. 1.
Figure 4:
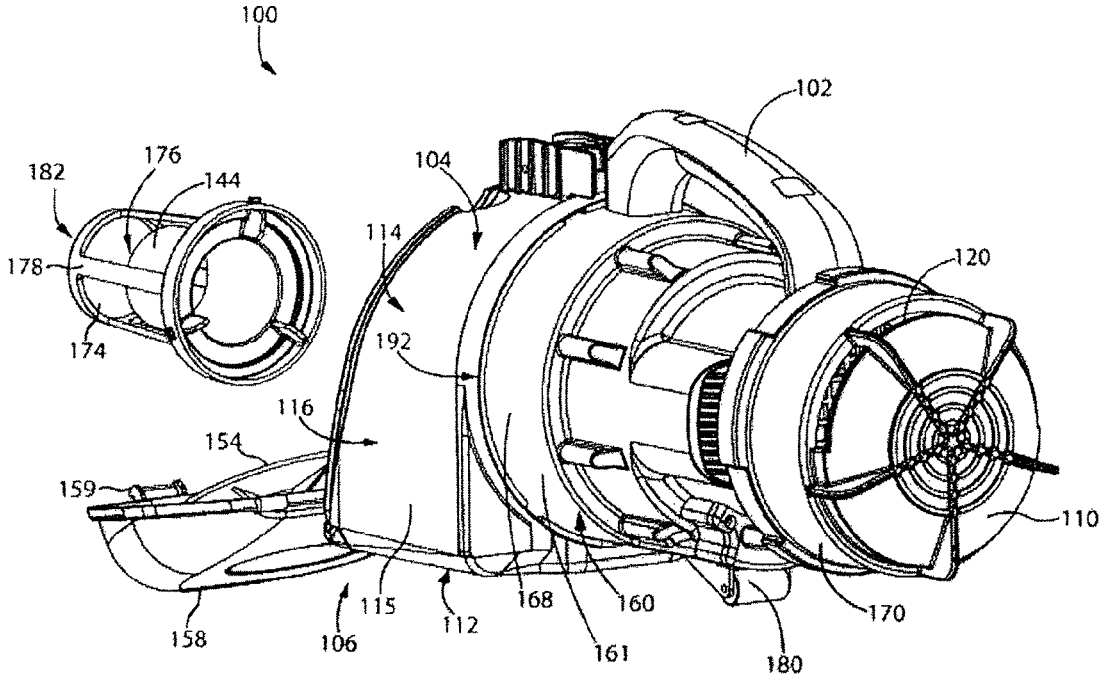
FIG. 4 is a partially exploded rear perspective view of the hand vacuum cleaner of FIG. 1.
Figure 5:
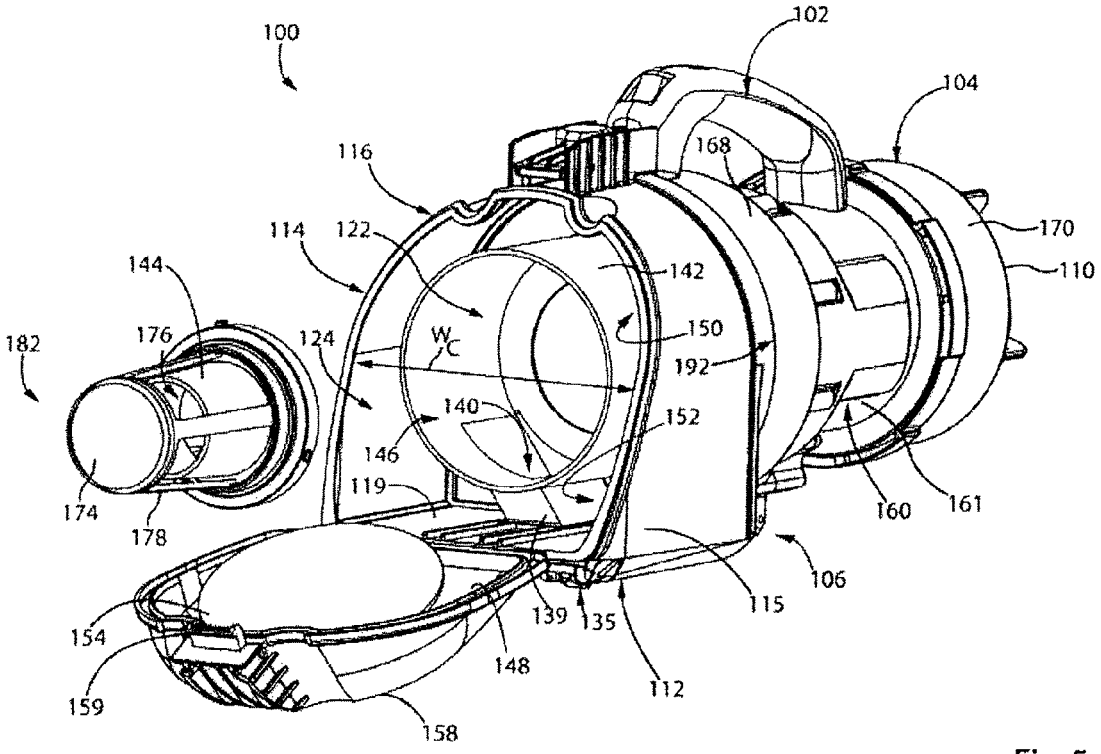
FIG. 5 is a partially exploded front perspective view of the hand vacuum cleaner of FIG. 1.

As shown in FIGS. 3 and 5, nozzle 112 has a width $W_N$, and air treatment unit or cyclone unit 114 has a width $W_C$. In the example shown, $W_N$, and $W_C$ are about the same. An advantage of this design is that the cleaning head 116, and a hand vacuum 100 including the cleaning head 116, may have a cleaning path that is essentially as wide as the cleaning head 116 itself.

Figure 7:
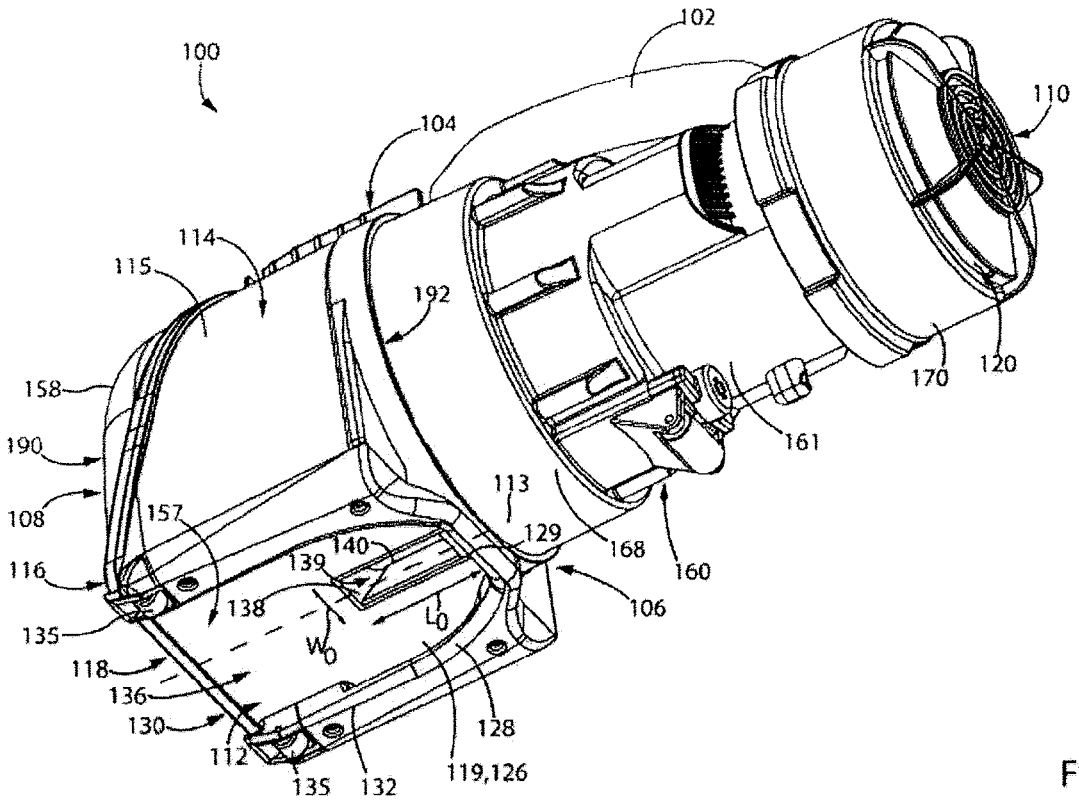
FIG. 7 is a bottom perspective view of the hand vacuum cleaner of FIG. 1.

As exemplified in FIG. 7, in accordance with another aspect, nozzle 112 defines an airflow chamber 136 wherein at least a portion, and more preferably a majority, of the lower surface of the chamber 136 is open. Nozzle 112 comprises an upper nozzle wall 126, which defines a closed upper end of the airflow chamber 136. In the example shown, the upper nozzle wall 126 comprises a portion of a lower wall of the vacuum cleaner 100, and more particularly, a lower portion 119 of a wall 115 of the air treatment unit 114. In an alternate design as exemplified by FIG. 8, nozzle 812 comprises a lower wall 837, which closes lower end 834. Accordingly, nozzle 112 may be of various designs and may be an open sided passage or a closed passage. The nozzle has an outlet that extends upwardly to a cyclone chamber.

Preferably, one or more depending walls 128 extend downwardly from the upper nozzle wall 126. The depending wall is preferably generally U-shaped. In the example shown, an opening 138 is provided in the lower outer wall 119 (i.e., in the upper nozzle wall 126), and is in communication with the airflow chamber 136. In one embodiment, depending wall is provided rearward of opening 138. In other embodiments, depending walls may alternately or in addition be provided on the lateral sides of opening 138. It is preferred that depending walls are provided on each lateral side of opening 138 and rearward thereof. Further, depending Preferably, the open end of the U-shape defines an open side 130 of the airflow chamber 136 (and of the nozzle 112), and forms the dirty air inlet 118 of the cleaner 100. A closed rear side 129 is preferably opposed to the open side 130. In use, when optional wheels 135 are in contact with a surface, the open side 130 sits above and is adjacent a surface to be cleaned (e.g., floor F). Depending walls 128 may extend a substantial distance to the front end 108 and, preferably, essentially all the way to front end 108. The depending walls may be continuous to define a single wall as shown, or may be discontinuous. The depending walls are preferably rigid (e.g., integrally molded with air treatment unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 inches to 0.175 inches, more preferably from 0.04 inches to 0.08 inches. Accordingly, some air may enter nozzle 112 by passing underneath depending wall 132. In such a case, the primary air entry to nozzle 112 is via open side 130 so that dirty air inlet 118 is the primary air inlet, with a secondary air inlet being under depending wall 128.

The height of the depending wall (between upper nozzle wall 126 and lower end 132) may vary, and defines the height of the airflow chamber 136. That is, the height of the airflow chamber extends between wall 126 and a lower end 132 of the depending wall. In some examples, the depending wall 128 may have a height of between about 0.05 inches and about 0.875 inches, preferably between about 0.125 inches and about 0.6 inches and more preferably between about 0.2 inches and about 0.4 inches. The height of depending wall 128 may vary but is preferably constant.

Figure 2:
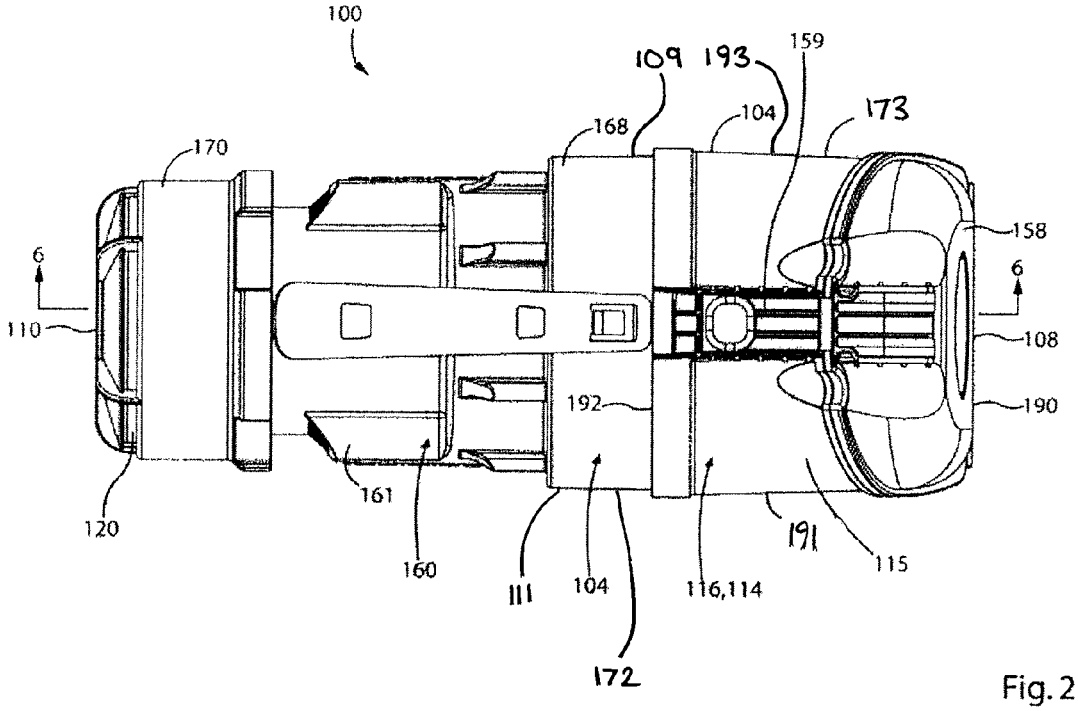
FIG. 2 is a top plan view of the hand vacuum cleaner of FIG. 1.

When viewed in plan view from above, as shown in FIG. 2, vacuum cleaner 100 defines a perimeter 172, which is defined by front 108, rear 110, and sides 109 and 111 extending therebetween. Further surface cleaning head 116 defines a perimeter 173, which includes a front end 190 at the front 108 of the hand vacuum cleaner 100, a rear end 192, and sides 191 and 193 extending therebetween. In the example shown, the open side 130 is positioned at the perimeter 172 of the vacuum cleaner 100, and at the perimeter of the surface cleaning head 116. More particularly, the open side 130 at the front 108 of the vacuum cleaner 100 and at the front 190 of the surface cleaning head 116. Accordingly, airflow chamber 136 extends to the front 108 of the vacuum cleaner 100, to the front end 190 of the surface cleaning head, and the dirty air inlet 118 is provided at the front 108 of the vacuum cleaner 100 and at the front end 190 of the surface cleaning head.

In the example shown, the lower end 132 of the depending wall 128 defines an open lower end 134 of the airflow chamber 136 (and of the nozzle 112). The open lower end 134 preferably extends to the front 108 of the cleaner 100, and merges with the open side 130. In use, the exemplified nozzle has an open lower end 134 that faces a surface to be cleaned. Accordingly, in use, when wheels 135 are in contact with a surface to be cleaned, such as a hard horizontal surface, the lower end 132 of the depending wall 128 is spaced from and above the surface, as mentioned hereinabove. As mentioned hereinabove, the space between the lower end of the depending wall 128 and the surface forms a secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 is provided. Preferably, the wheels are located adjacent front 108. Optionally, one or more rear wheels 108 may be provided. In an alternate embodiment, no wheels may be provided.

In the example shown, a plurality of wheels 135 are mounted to the depending wall 128. The wheels, and more particularly the lower end of the wheels, extend lower than the lower end 132 of the depending wall 128. That is, the lower end 132 of the depending wall 128 is spaced above the lower end of the wheels 135.

As mentioned hereinabove, the upper nozzle wall 126, depending wall 128, and open lower end 134 of the nozzle 112 define an open sided airflow chamber 136 of the nozzle. In use, when wheels 135 are in contact with a horizontal surface, the nozzle 112 and the airflow chamber 136 preferably extends generally horizontally, and preferably linearly along a nozzle axis 113 (see FIG. 7).

In the example shown, the airflow chamber 136 does not include a rotating agitator (i.e. has an absence of a rotating agitator). However, in alternate examples, the airflow chamber 136 may include a rotating agitator.

In the example shown, as mentioned hereinabove, an opening 138 is provided in the lower outer wall 119 (i.e in the upper nozzle wall 126), and is in communication with the airflow chamber 136. More particularly, airflow chamber 136 is upstream of opening 138. Opening 138 may be of any size and configuration and at various locations in upper nozzle wall 126. Opening 138 defines an inlet to an enclosed passage 139 or conduit leading to the air treatment unit. Opening 138 is positioned rearwardly of open side 130, preferably forwardly of a closed rear side 129, and above the airflow chamber 136. Accordingly, airflow chamber 136 extends from the dirty air inlet 118 rearwardly to the opening 138. Opening 138 has a width $W_o$, and in the example shown, is positioned inwardly from sides 109 and 111 by a distance that is at least the same as the width. Further, opening 138 has a length $L_o$ transverse to the width $W_o$, and, in the example shown, opening 138 is positioned rearwardly from the front 108 by distance that is at least the same as length $L_o$.

The portion of the airflow passage downstream of the opening 138 is enclosed. That is, the portion of the airflow passage between opening 138 and clean air outlet 120 is an enclosed conduit, and the opening 130 forms the entrance to this conduit.

In use, when wheels 135 are in contact with a surface, the opening 138 preferably faces a surface to be cleaned. Air travels from the open side wall 130, preferably generally horizontally through the airflow chamber 136, at least a portion of which is preferably under the vacuum cleaner 100 and under the cleaning head 116, and passes into the opening 138 and enters the air treatment unit 114. Opening 138 is in communication with a cyclone inlet passage 139, which is in communication with a cyclone air inlet 140 of cyclone 122 that is preferably directly above passage 139.

As exemplified, in accordance with another aspect, passage 139 extends upwardly from opening 138, and the cyclone 122, and preferably the cyclone air inlet 140 is above opening 138. More particularly, in the example shown, cyclone air inlet 140 is fixed above the opening 138. That is, in use, when dirty air inlet 118 is adjacent a surface to be cleaned, cyclone air inlet 140 is above opening 138, and is not repositionable with respect to opening 138. In other embodiments, passage 139 may extend generally upwardly (e.g., upwardly and rearwardly or upwardly and forwardly. Accordingly cyclone 122 may be above at least a portion of nozzle 112 but inlet 140 need not be directly above opening 138. If chamber 136 has a lower open side, it will be appreciated that the air may travel to cyclone inlet 140 through an enclosed conduit without being redirected through a 90° elbow. It will be understood that this aspect may be used in any surface cleaning head.

If air treatment unit 114 includes a cyclone, then cyclone 122 may be of any configuration and orientation. Preferably, as exemplified, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis 113, and preferably extends generally horizontally when cleaner 100 is in use and wheels 135 are seated on a surface. The cyclone 122 has an air inlet 140 and an air outlet 145, which, preferably are at the same end of cyclone 122. Preferably the air inlet and the air outlet are distal to front end 108. The cyclone air inlet and cyclone air outlet may be of any configuration known in the art and the cyclone air outlet may be covered by a screen or shroud or filter as is known in the art.

As exemplified, the cyclone air inlet 140 is defined by an aperture in the chamber wall 142. As can be seen in FIG. 5, the inlet passage 139 is configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144. In some examples, as shown in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt chamber 124. The dirt chamber may be internal or external to the cyclone chamber. Preferably, as exemplified, the dirt chamber is external. The dirt chamber may be in communication with the cyclone chamber by any means known in the art. Accordingly, one or more dirt outlets may be provided. Preferably, the dirt outlet is at the end opposed to the air inlet and, preferably, the dirt outlet is at the front end 108.

In the example shown, dirt chamber 124 comprises two portions. A first portion 148 is provided immediately adjacent the dirt outlet 146, and is at the front 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt chamber 124, adjacent the dirt outlet 146. The separation plate 154 aids in preventing dirt in dirt chamber 124 from re-entering cyclone 122. Preferably, plate 154 is spaced from dirt outlet 146 and faces dirt outlet 146. Plate 154 may be mounted by any means to any component in cyclone unit 114. As exemplified, the separation plate is mounted on an arm 156, which extends from a front wall 158 at the front 108 of the cleaner 100.

Cyclone unit 114 may be emptied by any means known in the art. For example, one of the ends of the cyclone unit 114 may be openable. As exemplified in FIGS. 4 and 5, air treatment unit wall 115 preferably comprises a front wall 158, which is at front end 190 of surface cleaning head 116. Front wall 158 is pivotally mounted to the lower outer wall 119 of the air treatment unit wall 115, such that cyclone unit 114 may be opened, and dirt chamber 124 may be emptied. When front wall 158 is pivoted away from the remainder of the air treatment unit 114, separation plate 154 and arm 156 also pivot away from the remainder of the air treatment unit. A latch 159 is provided, which secures front wall 158 to wall 115, and particularly to the lower portion 119 of wall 115. In alternate examples, front wall 158 may be removable from cyclone unit wall 115 or. Alternately, the opposed end of the cyclone unit 114 may be openable. A front opening wall 158 may be used to empty a dirt container even if a cyclone is not used.

The clean air exiting cyclone 122 passes through outlet passage 144, exits surface cleaning head 116, and passes into the cleaner body 160. In the example shown, the cleaner body 160 is positioned rearward of the surface cleaning head 116. The cleaner body comprises a housing 161, which preferably houses an optional pre-motor filter 162, a suction motor 164, and an optional post-motor filter 166.

In the exemplified embodiments, the vacuum cleaner preferably has a linear configuration. Accordingly, pre-motor filter 162 is preferably provided in the airflow path adjacent and downstream of the outlet passage 144. Pre-motor filter 162 serves to remove remaining particulate matter from air exiting the cyclone 122, and may be any type of filter, such as a foam filter. One or more filters may be used. If the vacuum cleaner is of a non-linear configuration, then pre-motor filter 162 need not be located adjacent outlet passage 144.

Suction motor 164 is provided in the airflow path adjacent and downstream of the pre-motor filter 162. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 122 extend in the same direction and are generally parallel. The suction motor 164 may be any type of suction motor. If the vacuum cleaner is of a non-linear configuration, then motor 164 need not be located adjacent pre-motor filter 162.

Post motor filter 166 is provided in the airflow path downstream of, and preferably adjacent, the suction motor 164. Post motor filter serves to remove remaining particulate mater from air exiting the cleaner 100. Post-motor filter 166 may be any type of filter, such as a HEPA filter.

Clean air outlet 120 is provided downstream of post-motor filter 166. Clean air outlet 120 comprises a plurality of apertures preferably formed in housing 161.

In the example shown, cleaner body 160 is removably mounted to surface cleaning head 116. For example, cleaner body 160 may be entirely removable from surface cleaning head 116, or pivotally mounted to surface cleaning head 116. Accordingly, cleaner body 160 and surface cleaning head 116 may be separated in order to provide access to the interior of cleaner body 160 or surface cleaning head 116. This may allow pre-motor filter 162 to be cleaned, changed, or serviced, or motor 164 to be cleaned, changed or serviced. Alternately, or in addition, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively. If no filter element is fixedly mounted to cleaning head 116, then cleaning head 116 may be removed and washed with water.

As can be seen in FIG. 6, housing 161 preferably comprises a first portion 168 housing pre-motor filter 162, and suction motor 164, and a second portion 170 housing post-motor filter 166. Second portion 170 is openable, such as by being removably mounted to first portion 168, such that post-motor filter 166 may be cleaned, changed, or serviced.

One or more additional wheels, such as rear wheels 180 may alternately, or in addition, be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128

Cleaning head 116 has been described herein with respect to hand vacuum cleaner 100. It will be appreciated that in alternate examples, cleaning head 100 may be provided on another type of vacuum cleaner, such as an upright vacuum cleaner, or a canister type vacuum cleaner.

Figure 8:
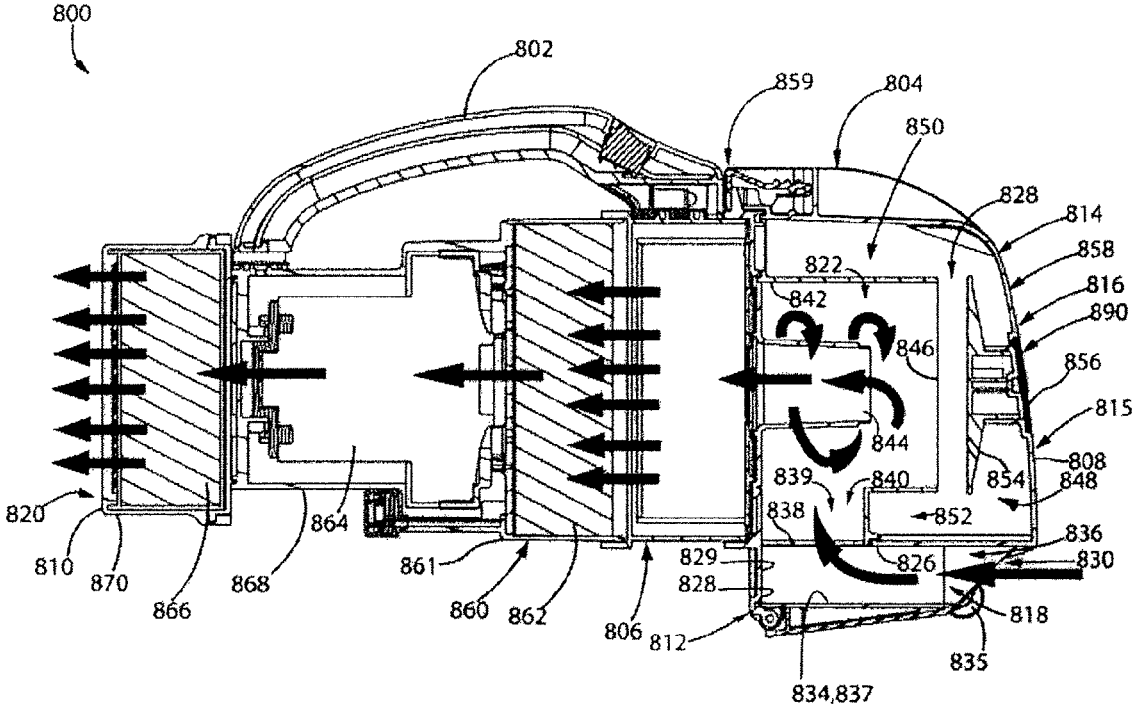
FIG. 8 is a cross section showing an alternate example of a hand vacuum cleaner.

Referring now to FIG. 8, in which like numerals refer to like features, with the first digit incremented to 8 to refer to the figure number, an alternate example of a hand vacuum cleaner 800 is shown. In this example, front wall 858 is not pivotally mounted to wall 815. Rather, wall surface cleaning head 816 is pivotally mounted to body 860.

The invention claimed is:

1. A hand vacuum cleaner comprising:

(a) an air flow passage extending from a dirty air inlet to a clean air outlet;

(b) an air treatment unit positioned in the air flow passage;

(c) a suction motor positioned in the airflow passage;

(d) the air treatment unit having an air treatment unit air inlet; and, (e) an airflow chamber having a closed upper end, at least one open side wall and an open lower end, the air treatment unit air inlet spaced from the open side wall and being unobstructed by a lower wall whereby, when the hand vacuum cleaner is positioned on a surface to be cleaned, the air treatment unit air inlet faces the surface and the air flow chamber defines a flow passage extending between the surface to be cleaned and the closed upper end such that air travels from the at least one open side wall between the surface to be cleaned and the closed upper end to the air treatment unit air inlet.

2. The hand vacuum cleaner of claim 1 wherein the air treatment unit air inlet provided in the upper end.

3. The hand vacuum cleaner of claim 1 the airflow chamber further comprises a depending wall extending downwardly from the closed upper end.

4. The hand vacuum cleaner of claim 3 wherein the depending wall is generally U-shaped.

5. The hand vacuum cleaner of claim 3 further comprising a plurality of wheels, the wheels having a lower end wherein the depending wall has a lower end that is spaced above the lower end of the wheels.

6. The hand vacuum cleaner of claim 5 wherein the lower end of the depending wall is positioned above a hard surface when the wheels are placed on the hard surface.

7. The hand vacuum cleaner of claim 5 wherein the airflow chamber has an upper wall comprises at least a portion of a lower wall of the hand vacuum cleaner, and the airflow chamber has an open side positioned adjacent a surface to be cleaned when the hand vacuum cleaner is in use, and the air flow chamber has a height that extends between the lower wall of the hand vacuum cleaner and the lower end of the depending wall.

8. The hand vacuum cleaner of claim 7 wherein the air treatment unit inlet is positioned in the upper wall.

9. The hand vacuum cleaner of claim 1 wherein the airflow chamber extends to a front end of the hand vacuum cleaner.

10. The hand vacuum cleaner of claim 9 wherein the dirty air inlet is positioned at a front end of the hand vacuum cleaner.

11. The hand vacuum cleaner of claim 10 wherein the airflow chamber extends from the dirty air inlet rearwardly to the air treatment unit air inlet.

12. The hand vacuum cleaner of claim 11 wherein the air treatment unit air inlet is positioned forwardly of a rear depending wall.

13. The hand vacuum cleaner of claim 1 further comprising a plurality of wheels and the airflow chamber has an airflow chamber axis that extends generally horizontally when the wheels are in contact with the surface to be cleaned.

14. The hand vacuum cleaner of claim 1 wherein the air treatment unit air inlet faces the surface to be cleaned when the hand vacuum cleaner is positioned on the surface to be cleaned.

15. The hand vacuum cleaner of claim 1 wherein the air treatment unit is positioned above the airflow chamber.

16. The hand vacuum cleaner of claim 1 wherein the air treatment unit comprises at least one cyclone.

17. The hand vacuum cleaner of claim 1 wherein the hand vacuum cleaner has a perimeter, a front end, a rear end and sides extending between the front end and the rear end, the at least one open side wall is positioned at the perimeter, and the air treatment unit air inlet has a width and is positioned inwardly from the sides by at least the same distance as the width.

18. The hand vacuum cleaner of claim 1 wherein the hand vacuum cleaner has a perimeter, a front end, a longitudinally displaced rear end and sides extending between the front end and the rear end, the at least one open side wall is positioned at the perimeter, and the air treatment unit air inlet has a longitudinal length and is positioned rearwardly from the front end by at least the same distance as the longitudinal length.

19. The hand vacuum cleaner of claim 18 wherein the air treatment unit air inlet has a width in a direction transverse to the longitudinal length and is positioned inwardly from the sides by at least the same distance as the width.

* * * * *